United States Patent [19]

Shirey

[11] Patent Number: 4,598,514

[45] Date of Patent: Jul. 8, 1986

[54] SUSPENSION CEILING GRID RUNNER WITH EXPANSION MEANS

[75] Inventor: Richard Shirey, Avon, Ohio

[73] Assignee: Donn Incorporated, Westlake, Ohio

[21] Appl. No.: 647,731

[22] Filed: Sep. 6, 1984

[51] Int. Cl.[4] ..... E04C 2/52; E04C 3/04

[52] U.S. Cl. ..... 52/232; 52/664; 52/DIG. 5

[58] Field of Search ..... 52/232, 573, DIG. 5, 52/729, 484, 485, 664

[56] References Cited

U.S. PATENT DOCUMENTS

| | | | |
|---|---|---|---|
| 3,142,367 | 7/1964 | Brown et al. | 189/37 |
| 3,175,655 | 3/1965 | Brown et al. | 189/82 |
| 3,189,139 | 6/1965 | Znamirowski et al. | 52/232 X |
| 3,388,519 | 6/1968 | Downing, Jr. | 52/495 |
| 3,390,503 | 7/1968 | Emerick, Jr. et al. | 52/573 |
| 3,589,089 | 6/1971 | Kedel | 52/232 |
| 3,778,947 | 12/1973 | Sauer | 52/232 |
| 3,965,631 | 6/1976 | Sauer | 52/232 |
| 4,021,986 | 5/1977 | McCall et al. | 52/475 |
| 4,108,563 | 8/1978 | Brown et al. | 403/347 |
| 4,128,978 | 12/1978 | Beynon | 52/232 |
| 4,206,578 | 6/1980 | Mieyal | 52/730 |
| 4,394,794 | 7/1983 | Shirey | 29/432 |

*Primary Examiner*—Stuart S. Levy
*Assistant Examiner*—Lynn M. Sohacki
*Attorney, Agent, or Firm*—Pearne, Gordon, Sessions, McCoy, Granger & Tilberry

[57] ABSTRACT

A fire-rated type suspension ceiling grid runner is disclosed having expansion means intermediate its ends which collapse when the runner expands due to elevated temperatures occurring during a fire or the like. The runner provides a boxlike panel supporting flange along the lower end of the web thereof in which slots are formed to define a flange segment and connecting legs. When the expansion means collapses, the flange segment is laterally displaced as a unit and remains connected to each adjacent portion of the boxlike flange by at least two longitudinally spaced legs. The displaced flange segment functions as a bridging beam which continues to connect the adjacent portions of the flange and maintain them in alignment so that a grid formed of the runners can continue to maintain proper support for panel even when fire conditions occur.

17 Claims, 8 Drawing Figures

SUSPENSION CEILING GRID RUNNER WITH EXPANSION MEANS

BACKGROUND OF THE INVENTION

This invention relates generally to suspension ceiling grid systems, and more particularly to a novel and improved expansion structure for grid runners having a boxlike panel supporting flange.

PRIOR ART

Grid runners for suspension ceiling systems are often provided with expansion structures which accommodate longitudinal expansion of the runner when the runner is exposed to excessive temperatures, such as the temperatures which result when fires occur. Such expansion structures are intended to allow the runners to expand longitudinally without destroying the integrity of the ceiling so that the panels will not be dropped from the ceiling grid and will continue to provide a fire-resistant barrier which helps contain the fire in a given location.

Examples of such expansion structures are illustrated in U.S. Pat. Nos. 3,142,367; 3,175,655; 3,388,519; 3,390,503; 3,589,089; 3,778,947, and 3,965,631. In each of these prior art grid runners, the panel supporting flanges are substantially planar and the flanges can therefore deflect or buckle easily.

When, however, a grid runner is formed with a boxlike panel supporting flange of the type illustrated in U.S. Pat. No. 4,021,986, such prior art expansion systems cannot be employed effectively.

SUMMARY OF THE INVENTION

In accordance with the present invention, a novel and improved grid runner structure for suspension ceiling grids is provided. Such grid runner provides a boxlike panel supporting flange structure in combination with an expansion structure that accommodates longitudinal expansion which occurs when a runner is exposed to high temperature conditions, such as the temperatures that occur during a fire. With such runners, the expansion structure collapses in a controlled manner so as to maintain the grid portions on either side of the expansion structure substantially aligned. With such runner, the integrity of the grid is maintained during a fire and the tendency for panels to drop out of the grid during the expansion of the grid is substantially eliminated.

In the illustrated embodiment, the runner provides a central web, a stiffening spine or bulb along the upper side of the web, and a boxlike panel supporting flange structure along the lower side of the web. Such boxlike flange includes aligned lateral portions extending in opposite directions from the lower extremity of the web, a pair of spaced and parallel depending flange side walls extending from the outer edge of the associated lateral portions, and inturned lips at the lower extremity of the depending side walls. The inturned lips terminate at spaced, opposed edges.

The expansion structure includes an opening in the web, a flattened and angulated bulb portion, and diagonal cuts or slots in the depending walls. The opening in the web allows the adjacent portions of the web to move toward each other when the runner expands. The flattened bulb portion deforms laterally and folds to allow adjacent portions of the bulb to move toward each other. The slots in the flange portion cause a segment of the flange to move laterally as a unit to provide a bridging beam structure which remains connected to the adjacent flange portions to maintain them in substantial alignment as they move toward each other.

The opening in the web is shaped so as to provide well-defined bend lines which cooperate with the slots formed in the flange portion to cause the flange segment between the slots to be displaced downwardly as the runner expands and the expansion structure collapses. During the collapsing movement, portions of the flange bend laterally, providing connecting legs which maintain a good connection between the displaced segment of the flange and the adjacent portions of the grid.

Consequently, during and after the expansion, the boxlike flange segment which is displaced laterally is joined to each adjacent portion of the runner by a plurality of laterally extending connecting legs. This assures that the displaced flange segment provides a continuing connection with the adjacent portions of the runner to prevent any material lateral buckling or bending of the runner in the plane of the web. Because of this controlled collapsing movement of the expansion structure, a good connection is provided with the adjacent portions of the runner, and the runner is maintained substantially straight so that it can maintain the integrity of the grid and continue to support the panels carried thereby.

Further, the legs provide a continuing resistance to the collapsing movement that prevents rapid movement within the grid which could shake panels loose.

These and other aspects of this invention are illustrated in the accompanying drawings and are more fully described in the following specification.

DETAILED DESCRIPTION OF THE DRAWINGS

When a suspension ceiling is termed "fire-rated," it must be capable of retaining its integrity for a specified length of time, e.g., two hours, when exposed to temperatures that occur during a fire. In a typical fire-rated suspension ceiling system, the panels are formed of a material which does not expand to any material extent under fire conditions. In fact, many such materials tend to shrink a small amount. The grid runners, however, being formed of metal, expand sustantially when exposed to high temperatures existing in fires. Unless such longitudinal expansion is accommodated within the grid, the runners tend to buckle, bend, or twist, and the panels drop out of the grid, destroying the integrity of the ceiling.

In order to prevent loss of such integrity of the ceiling, means must be provided to accommodate the expansion of the grid runners in a manner which allows the runners of the grid to maintain proper panel support even during high temperature conditions occurring during a fire.

As mentioned above, various systems have been developed. Some such systems provide expansion means integrally formed within the runner intermediate its ends which collapse to accommodate the longitudinal expansion of the runners of a grid. Such systems typically provide grid runners in which the lower portion of the runner provides a relatively flat or planar panel support flange, an upstanding web, and a stiffening spine or bulb along the upper edge of the web. In most such systems, the flanges have been structured to bend down when the expansion means collapse. Such bending can be relatively easily accommodated because of the planar structure of the panel supporting flanges.

Further in such systems, the runners have been generally provided with a relatively wide flange, in the order of one inch in width, so that the panels overlap the panel supporting flanges a substantial amount. Consequently, the runner systems could tolerate significant grid runner distortion without loss of panel support.

In the illustrated embodiment of this invention, the grid runner is provided with a boxlike panel supporting flange which does not readily bend or fold when expansion of the grid runner occurs. Further, such illustrated runners are often structured with a relatively narrow face, in the order of 9/16 inch width. Therefore, a smaller amount of panel overlap exists and proper support of the panel during fire conditions requires that the runners distort a very minimal amount.

Figures 1, 2:
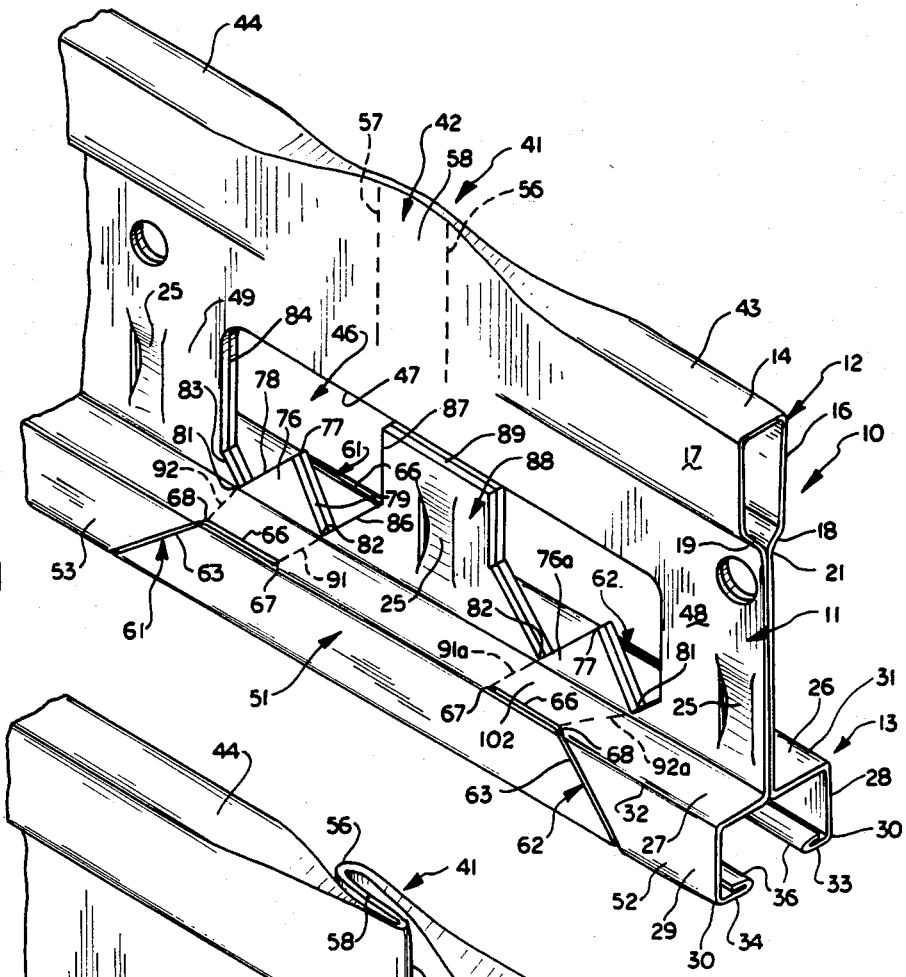
FIG. 1 is a perspective view of a portion of a suspension ceiling grid runner in accordance with the present invention, illustrating the expansion structure in its normal condition before collapse.
FIG. 2 is a perspective view similar to FIG. 1, illustrating the runner after the expansion structure has been fully collapsed.

FIG. 1 illustrates the structure of the runner and the expansion means prior to the collapse of the expansion means which would occur during a fire condition. FIG. 2 illustrates the same runner after the expansion means has fully collapsed.

The illustrated runner 10 provides a central web 11, a stiffening spine or bulb 12, and a boxlike panel supporting flange 13. Such runner is formed of sheet metal bent to provide a lateral wall 14 from which substantially parallel bulb side walls 16 and 17 extend. At the lower edges of each of the side walls, the sheet metal is inclined inwardly along wall portions 18 and 19 until it abuts at 21. Therefore, the bulb 12 is a hollow, beamlike structure extending lengthwise of the runner along the upper edge of the web 11. It should be understood that within the broader aspects of this invention other bulb shapes can be utilized. Further, in some instances, an additional strip of metal may be enclosed within the bulb as illustrated in U.S. Pat. No. 4,206,578, or the material of the bulb may be folded or shaped to provide additional material in the bulb for increased rigidity and stiffness.

From the point 21, the metal forming the grid runner extends in abutting relationship to provide a two-layered web 11. The two layers of the web 11 are connected together by connections 25 spaced at intervals along the web. Such connections may be formed as illustrated in U.S. Pat. No. 4,394,794, or by other means such as spot welding or lance stitching.

At the lower edge of the web 11, the metal forming the grid extends laterally to provide lateral flange portions 26 and 27 extending in opposite directions from the central web 11 in a coplanar relationship. Depending flange side walls 28 and 29 extend downwardly from the outer edges of the lateral flange portions 26 and 27, respectively, with the depending flange side wall 28 joined to the lateral flange portion 26 at a first bend line 31 and the other depending flange side wall 29 joined to the outer edge of the lateral flange portion 27 at a second bend line 32.

At the lower edges of each of the depending flange side walls 28 and 29, the metal forming the runner is bent inwardly along bend lines 30 to provide inwardly extending, coplanar lips 33 and 34, respectively. Such lips are hemmed at their inner edges so that each lip provides a smooth inner edge 36 and two layers of material for at least a portion of its width. The inner edges 36 of the two lips 33 and 34 are spaced from each other so that a relatively narrow opening is provided along the lower surface of the runners extending lengthwise of the runner.

The runners 10 are interconnected in a grid by end connections (not illustrated) so that the grid defines a plurality of openings in which ceiling panels are positioned. Such end connections and the particular pattern of the grid are not illustrated herein because such connections and patterns are well known to those skilled in the art. However, one such connection is illustrated in U.S. Pat. No. 4,108,563, and such patent is incorporated herein by reference to illustrate one suitable connecting system.

When a grid is assembled from runners 10, panels are installed within the grid that provide edge portions which project over the lateral flange portions 26 and 27, to support the panels on the grid runners. Generally, panels which are used in combination with runners of the structure illustrated are rabbeted along their edges so as to provide a peripheral edge which extends over the lateral flange portions 26 and 27 and to provide lateral faces which extend down along and engage the depending flange walls 28 and 29, as illustrated in U.S. Pat. No. 4,021,986, which is also incorporated herein by reference.

Although a grid runner structured with a cross section as illustrated in the drawings can be formed with a relatively wide lateral flange portion so as to provide a substantial overlap between the panels and the flange portion of the runners, grid runners of such structure are often provided with a relatively narrow flange portion 13 in which the lateral spacing between the depending flange side walls 28 and 29 is in the order of 9/16 inch. When the grid runners are formed with such a narrow, boxlike panel supporting flange structure, the overlap of the panels along the lateral flange portions 26 and 27 is relatively small and it is essential that the grid runners remain substantially straight and undistorted during fire conditions if the integrity of the ceiling is to be maintained by continuing support of the panels within the grid. In accordance with the present invention, an expansion structure is provided which maintains very good alignment between the portions of the grid on either side of the expansion structure even when the expansion structure is collapsed due to fire conditions or the like.

In FIG. 1, the grid runner 10 is illustrated with the expansion structure 41 prior to any collapse thereof. In FIG. 2, the expansion structure 41 is fully collapsed and is illustrated in the condition it moves toward after being exposed to fire conditions. It should be understood that, as discussed in greater detail below, the expansion structure during its collapse progressively moves toward the illustrated fully collapsed position and at a given instance or a given situation the expansion structure may be only partially collapsed and not be fully collapsed as illustrated in FIG. 2. It should also be understood that additional expansion structures 41 are often provided at intervals along the length of the runner 10 so that the runner 10 can expand without buckling or the like even when the grid from which the runners are formed is exposed to the maximum temperatures contemplated.

There are three separate components to the expansion structure 41 which coact and allow a controlled expansion of the runner 10. The first component 42 of the expansion structure involves the bulb 12 and a portion of the web adjacent thereto, and allows adjacent bulb portions 43 and 44 on either side of the expansion structure 41 to move toward each other as the expansion structure collapses.

The second component 46 of the expansion structure is provided by an opening 47 in the web 11 which allows the adjacent web portions 48 and 49 on either side of the opening 47 to move toward each other during the collapse of the expansion structure.

The third component of the expansion structure 51 involves the boxlike panel supporting flange 13 and allows the adjacent flange portions 52 and 53 to move toward each other during the collapse of the expansion structure 41.

Referring specifically to the first component 42, such component is provided by flattening the bulb 12 so that the metal forming the bulb is substantially fully closed from about the dotted line 56 to the dotted line 57 to provide a flattened section 58 in which the layers of metal forming the bulb are substantially completely closed. On either side of the flattened portion 58 beyond the lines 56 and 57, a transition section is provided along which the side walls of the bulb diverge until the normal bulb cross section exists.

Figure 4:
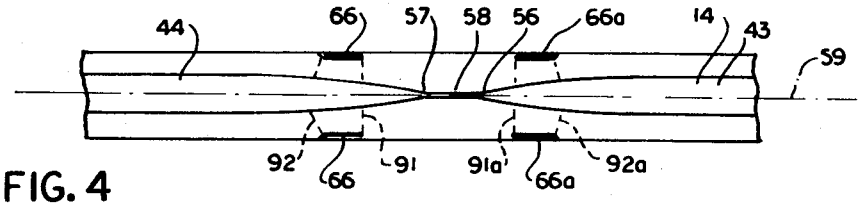
FIG. 4 is a plan view of the runner illustrated in FIG. 3.
Figure 7:
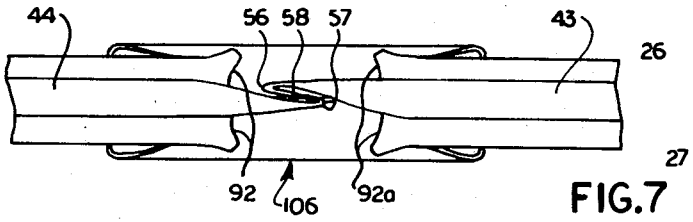
FIG. 7 is a plan view of the runner illustrated in FIG. 6.
Figure 8:
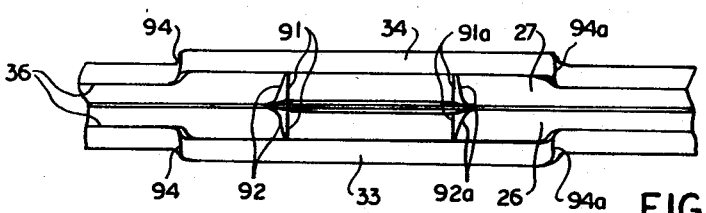
FIG. 8 is a bottom view of the runner illustrated in FIG. 6.

As best illustrated in FIG. 4, the flattened section 58 is angulated at a small angle with respect to the longitudinal axis 59 of the runner so that when the runner is subjected to compressive stress created by the expansion of the material forming the runner, the flattened section 58 of the bulb and the adjacent portion of the web above the opening 47 commence to bend along bend lines substantially coincident with the lines 56 and 57 toward a folded condition illustrated in FIG. 7. In effect, the flattened section provides a hinge system which folds in an overlapping manner from the condition of FIG. 4 to the condition of FIG. 7 as the expansion structure 41 collapses.

The component 42 of the expansion structure is substantially as disclosed and claimed in U.S. Pat. No. 3,965,631, assigned to the assignee of the present invention, and such patent is incorporated herein by reference to provide a more detailed description of the structure and mode of operation of such component.

The component 51 of the expansion structure relates to the boxlike flange 13 and includes two pairs of symmetrical and opposite slots or cuts 61 and 62 provided in both sides of the boxlike flange. Each of the pairs of cuts or slots 61 includes an inclined portion 63 along the associated flange side walls 28 and 29 extending from the associated bend 31 or 32 to the associated bend 30. At the ends of the inclined portion, the slots provide longitudinal portions 66 extending along the associated bend lines 31 and 32 to ends 67. The portions 66 and 63 intersect at junctions 68. Similarly, the slots 61 provide lower longitudinal portions 71, best illustrated in FIG. 5, which extend a short distance along the bend lines 30 between the flange side walls and the lips.

The pair of slots 62 are identical in structure, but mirror opposites of the slots 61. Consequently, the slots 62 provide an inclined portion 63 extending along the associated side walls 28 and 29 and longitudinal portions 66 and 71, illustrated in FIGS. 4 and 5, substantially along their associated bends. The length of the longitudinal portions 66 is equal to the length of the longitudinal portions 71.

Figure 3:
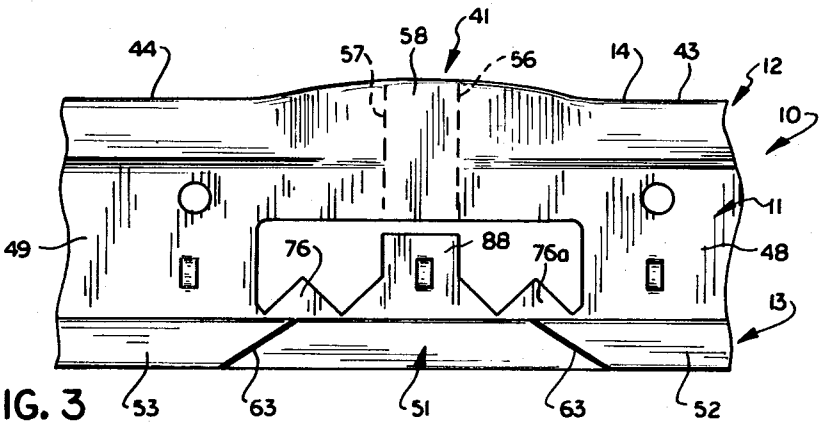
FIG. 3 is a side elevation of a runner in accordance with the present invention, illustrating the expansion structure incorporated therein.

Adjacent to the longitudinal portions 66, the opening 47 is shaped as best illustrated in FIGS. 1 and 3 to provide a central upstanding projection 88 and identical upstanding projections 76 and **76*a* on either side thereof. Such projections 88, 76 and 76*a* are formed by the portions of the web which remain when the cut-out or opening 47 is formed within the web. The projections 76 and 76*a* extend upwardly to upper extremities 77 spaced a substantial distance from the upper edge of the opening 47 and provide diverging edges 78 and 79, which extend downwardly and apart to lower extremities 81 and 82 at the plane of the flange portions 26 and 27. The two sides 78,79 are inclined at an angle of about 45 degrees with respect to the longitudinal axis of the runner and provide an included angle at the upper extremities 77 of 90 degrees. From the lower extremity 81, the opening provides a short, inclined edge 83 extending upwardly at an angle of about 45 degrees to a vertical edge 84**.

From the lower extremity 82, the central projection 88 provides another inclined edge 86 extending upwardly at about a 45-degree angle to a vertically extending edge 87 to define the sides of the central upstanding projection 88. The central projection 88 provides an upper edge 89 spaced a short distance from the top of the opening 47. The central projection 88 and the projections 76 and **76*a* function to stiffen the adjacent lateral flange portions 26 and 27 to maintain them straight and cooperate with the adjacent slots 61 and 62 to establish bend lines, indicated by the dotted lines 91 and 91*a*. Such bend lines extend between the ends 67 and the associated extremities 82. The ends 67 are substantially in lateral alignment with the associated extremities 82 so that the bend lines 91 and 91*a* extend substantially perpendicular to the web across the associated lateral flange portions 26 and 27**.

The junction 68 between the inclined portions 63 and the longitudinal portions 66 cooperates with adjacent extremities 81 to define a second pair of bend lines 92 and **92*a* associated with the bend lines 91 and 91*a*, respectively. Such bend lines 92 and 92*a* are indicated in FIG. 1 by dotted lines. The bend lines 92 and 92*a*, however, do not extend perpendicular to the plane of the flange, but are inclined with respect thereto because the length of the associated longitudinal portion 66 is smaller than the width of the projections 76 and 76*a*. The purpose of providing an angulated or inclined bend line 92 and 92*a*** is discussed in detail below.

Figure 5:
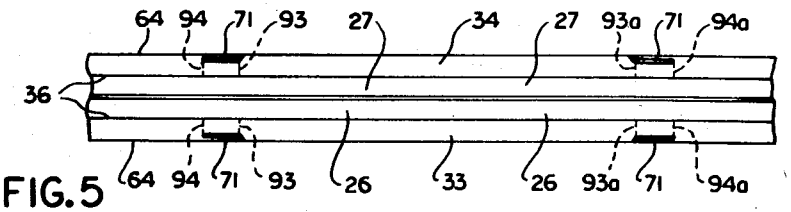
FIG. 5 is a bottom view of the runner illustrated in FIG. 3.
Figure 6:
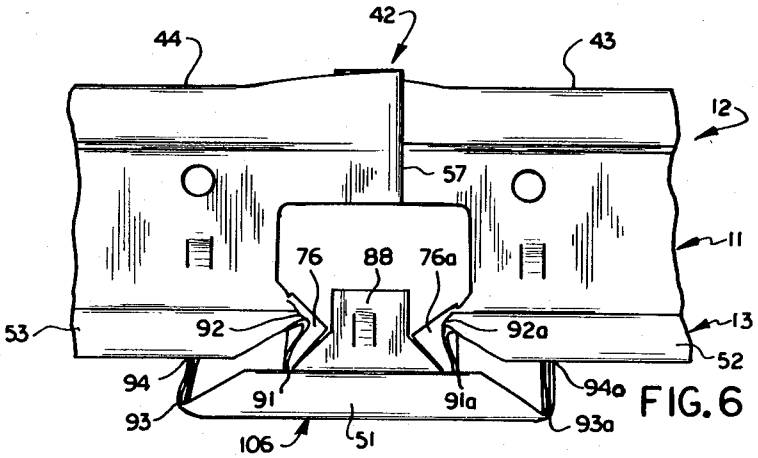
FIG. 6 is a side elevation of the runner illustrated in FIG. 3 after the expansion structure has been collapsed.

Referring to FIG. 5, additional bend lines are formed in the lips 33 and 34 by the ends of the longitudinal portion 71 of the slots. A first pair of bend lines 93, indicated by dotted lines, extend inwardly from the inner ends of the longitudinal portions 71 of the slots 61 where such longitudinal portions intersect the associated inclined portions 83 (illustrated in FIGS. 1 and 3). A second pair of bend lines 93*a* extend across the associated lips from the inner ends of the longitudinal portions 71 of the slots 62, where such portions intersect the associated inclined portions 63.

Additional bend lines 94 and 94*a* extend from the outer ends of the associated longitudinal portions 71 across the associated lips 36.

When the runner is subjected to compressive stresses created by thermal expansion of the material of the runner, the various components of the expansion structure 41 move from the position of FIG. 1 toward the position of FIG. 2 to cause a lateral displacement of the segment 106 between the slots 61 and 62 of the boxlike flange portion 13 laterally downward. Initially, the inclined portion 63 of the slots 61 and 62 provides a camming action as the portions 52 and 53 attempt to move toward each other. This camming action causes the initial bending along the bend lines 91, 91*a*, 92, 92*a*, 93, 93*a*, and 94, and 94*a*.

Connecting portions or legs are created by the bending movement between the various bend lines, with a first leg assembly 101 being provided by that part of the lateral flange portions 26 and 27 between the bend lines 91 and 92 in cooperation with the projection 76 and another leg assembly 102 being provided by a part of the flanges 26 and 27 between the bend lines 91*a* and 92*a* in cooperation with the projection 76*a*. In reality, there are two legs provided by the leg assembly, with one on each side of the projection 76, and a similar pair of legs provided by the leg assembly 102 on either side of the projection 76*a*.

An additional two pair of legs are created from the lips 33 and 34, with one pair of connecting legs 103 being provided by the part of the lips 33 and 34 between the bend lines 93 and 94 and the other pair of connecting legs 104 being provided by the lips 33 and 34 between the bend lines 93*a* and 94*a*. As the collapse of the expansion structure 41 occurs, the bending progresses from the inline position of FIG. 1 toward the position of full collapse illustrated in FIG. 2. During such movement, the segment 106 of the boxlike flange which moves laterally provides a bridging beam structure extending across the expansion structure. Such bridging beam structure 106, because it is connected to the adjacent portions 52 and 53 of the boxlike flange by longitudinally spaced legs 101 and 103 in the case of the portions 53 and 102 and 104 in the case of the portion 52, provides a connecting structure which maintains the flange portions 52 and 53 in alignment. During the collapsing movement, the projections 76 and 76*a* rotate inwardly until their edges engage the mating edges of the central projection 88 in the fully collapsed position. The central projection 88 is provided with a connection 25 which ties together the two sides of the displaced beam and also provides additional stiffness to the displaced beam segement 106 as such segment moves laterally during the collapsing movement of the expansion structure 41.

It is desirable to provide a structure which collapses without any sudden movements, since sudden movement of the expansion structure tends to cause shaking within the grid, which tends to cause panels to fall out of the grid to destroy the integrity of the ceiling. It is for this reason that the pairs of bend lines 91 and 92 and 91*a* and 92*a* are not parallel to each other. Because the bend lines 92 and 92*a* are angulated with respect to the associated bend lines 91 and 91*a*, the metal forming the legs 101 and 102 cannot fold down in a planar manner. Instead, the material forming such legs must be deformed beyond its elastic limit, and this provides a continuing resistance to the collapsing movement of the expansion structure as the collapsing occurs. It has been found in tests that as the temperatures of the grid runners increase, the various expansion structures within the grid progressively but relatively slowly collapse without creating any sudden movements which would cause panels to shake out of the grid. Further, it has been found that even though the folding movement of the bulb component 42 tends to cause some lateral displacement of the bulb portion of the runner during the collapsing movement, the bridging beam system at the flange side of the runner maintains the flange portions of the runner adjacent to the expansion structure in good alignment so that even panels supported by relatively narrow flanges with a relatively small amount of overlap are properly supported during the collapsing movement of the expansion structure.

After the expansion structure starts to collapse, the beam connection provided by the bridging flange segment 106 cooperates with the connection provided by flattened bulb portion 58 to provide a strong continuing structure so that the runner can continue to support the panel load.

It should further be noted that the presence of the slots 61 and 62 does not materially weaken the runner in its normal load supporting capacity, since the slots do not extend across either the lips 33 and 34 or the flanges 26 and 27. Normally, these portions of the runner are in tension and the presence of the slots does not materially weaken the runner structure for normal operation.

Although the preferred embodiment of this invention has been shown and described, it should be understood that various modifications and rearrangements of the parts may be resorted to without departing from the scope of the invention as disclosed and claimed herein.

What is claimed is:

1. An elongated metal grid runner for suspension ceilings comprising a central web, beamlike flange means along one edge of said web adapted to support ceiling panels, and expansion means operable to collapse when said runners longitudinally expand, said expansion means providing an opening in said web and separation means in said flange means separating an elongated displaceable segment of said flange means from the adjacent portions thereof, expansion of said runner causing said displaceable segment to move laterally with respect to said flange means as said adjacent portions of said flange means move toward each other, said expansion means providing connecting means connecting said displaceable segment and each adjacent portion of said flange means, upon collapse of said expansion means said displaceable segment operating as a substantially rigid elongated beam extending substantially parallel to said flanges bridging between said adjacent portions of said flange means which opeates through said connecting means to maintain said adjacent portions of said flange means in substantial alignment.

2. An elongated grid runner as set forth in claim 1, wherein said connecting means includes at least two longitudinally spaced legs connecting said displaceable segment and each of said adjacent portions of said flange means.

3. A suspension ceiling grid runner as set forth in claim 2, wherein the material of some of said legs is deformed as said expansion means collapses in a manner providing a relatively uniform resistance to said collapse.

4. An elongated grid runner as set forth in claim 2, wherein a substantial part of the material of at least some of said legs is progressively deformed beyond its elastic limit as said expansion means collapses to provide substantial resistance to continued collapsing movement.

5. An elongated grid member as set forth in claim 4, wherein said beamlike flange means has a boxshape providing coplanar panel supporting lateral portions extending from opposite sides of said web, spaced side walls depending therefrom and inturned lips along the side thereof spaced from said web, said displaceable segment including part of said lateral portions as well as part of said side walls and said lips, said displaceable segment remaining substantially straight and parallel to the length of said runner during lateral displacement thereof.

6. An elongated runner as set forth in claim 5, wherein said separation means include diagonal slots extending along said side walls operating to cam said displaceable segment laterally when said expansion means commences to collapse.

7. An elongated runner as set forth in claim 5, wherein said legs include parts of said lateral portions and said lips, and said separation means includes slots formed along said flange means which define said displaceable segment and at least part of said legs.

8. An elongated runner as set forth in claim 7, wherein said slots cooperate with said opening in said web to establish bend lines at the ends of said legs.

9. An elongated runner as set forth in claim 8, wherein said bend lines of at least some of said legs are non-parallel causing substantial portions of the materials of said legs to be stressed beyond their elastic limits to provide said resistance to continued collapsing movement.

10. An elongated runner as set forth in claim 9, wherein said opening is shaped so that part of the material of said web remains with said displaceable segment and contributes to the strength and rigidity thereof.

11. An elongated runner as set forth in claim 10, wherein said opening is shaped so that part of the material of said web forms a portion of at least some of said legs and adds strength thereto.

12. An elongated runner as set forth in claim 1, wherein said runner provides a hollow bulb along the other edge of said web, and said expansion means includes bulb collpase means operable to cause a portion of said bulb to collapse when said runner expands.

13. An elongated runner as set forth in claim 12, wherein said bulb collapse means includes a flattened and angulated portion which folds when said expansion means collapses.

14. A suspension ceiling grid runner as set forth in claim 1, wherein said runner provides a stiffening bulb along the other edge of said web, said bulb including a flattened bulb portion angulated with respect to said runner which folds along bend lines as said expansion means collapses, said flattened bulb portion cooperating with said displaceable segment to maintain the portions of said flange means on either side of said expansion means substantially aligned as said expansion means collapses.

15. A metal suspension ceiling grid runner comprising a web and boxlike panel supporting flange means along one edge of said web, said boxlike flange means including substantially coplanar lateral portions extending laterally in opposite directions from said one edge of said web, a pair of depending side walls joined to associated lateral portions at first bend lines, and a pair of inturned lips extending inwardly from associated side walls at second bend lines, and expansion means intermediate the ends of said runners, said expansion means including an opening in said web allowing adjacent web portions to move toward each other when said runner expands, and separating means causing an elongated substantially straight displaceable segment of said boxlike flange means to move laterally and remain substantially straight and parallel to the adjacent portions of said boxlike flange means to allow said adjacent portions of said flange means to move toward each other when said runner expands.

16. A suspension ceiling grid runner as set forth in claim 15, wherein said displaceable segment remains substantially straight and remains connected to each adjacent portion of said runner by at least two longitudinally spaced connecting legs which tend to retain said adjacent portions of said runner aligned.

17. A suspension ceiling grid runner as set forth in claim 16, wherein said legs are provided by part of the material of said lateral portions and said inturned lips.

* * * * *